US006257667B1

(12) United States Patent
Boren et al.

(10) Patent No.: US 6,257,667 B1
(45) Date of Patent: Jul. 10, 2001

(54) PIVOT BRACKET AND CONVERTIBLE SEAT

(75) Inventors: Kelly LaMarr Boren, Marysville; John Harley Canada, Camono Island, both of WA (US)

(73) Assignee: Bayliner Marine Corporation, Everett, WA (US)

( * ) Notice: Subject to any disclaimer, the term of this patent is extended or adjusted under 35 U.S.C. 154(b) by 0 days.

(21) Appl. No.: 09/345,578

(22) Filed: Jun. 30, 1999

(51) Int. Cl.[7] ..... B60N 2/02

(52) U.S. Cl. ..... 297/353; 248/291.1; 297/374; 297/376; 297/357

(58) Field of Search ..... 297/353, 357, 297/354.1, 354.13, 376, 374; 248/291.1, 371, 133

(56) References Cited

U.S. PATENT DOCUMENTS

| | | | | |
|---|---|---|---|---|
| D. 194,670 | | 2/1963 | Hamilton et al. | D15/1 |
| D. 303,878 | | 10/1989 | Goldsmith | D6/368 |
| 513,735 | | 1/1894 | Russell . | |
| 2,503,527 | | 4/1950 | Van Camp | 155/45 |
| 2,585,447 | * | 2/1952 | Eichorst | 297/376 |
| 2,627,894 | | 2/1953 | Herider et al. | 155/5 |
| 3,441,313 | * | 4/1969 | Persson | 297/374 |
| 3,544,160 | * | 12/1970 | Karasick | 297/354.1 |
| 3,596,981 | | 8/1971 | Koziol | 297/64 |
| 3,738,705 | | 6/1973 | Hill | 297/377 |
| 3,743,350 | | 7/1973 | Allen | 297/94 |
| 4,268,086 | | 5/1981 | Okuyama | 297/63 |
| 4,274,674 | * | 6/1981 | Deloustal | 297/376 X |
| 4,318,568 | | 3/1982 | Ericsson | 297/354 |
| 4,392,686 | * | 7/1983 | Beer | 297/376 |
| 4,402,546 | * | 9/1983 | Johnson | 297/374 |
| 4,496,189 | | 1/1985 | Tanizaki et al. | 297/63 |
| 4,525,009 | * | 6/1985 | De La Sota Martinez | 297/357 X |
| 4,685,719 | | 8/1987 | Hanemaayer | 296/156 |
| 4,802,706 | | 2/1989 | Onimaru et al. | 296/68 |
| 5,483,708 | | 1/1996 | Binfaré | 5/12.1 |
| 5,584,082 | | 12/1996 | Crawford et al. | 5/86.1 |
| 5,639,141 | | 6/1997 | Hanemaayer | 296/156 |
| 5,718,479 | | 2/1998 | Rautenbach | 297/354.13 |
| 5,768,724 | | 6/1998 | Buell | 5/118 |

* cited by examiner

*Primary Examiner*—Peter M. Cuomo
*Assistant Examiner*—Stephen Vu
(74) *Attorney, Agent, or Firm*—Seed Intellectual Property Law Group PLLC

(57) ABSTRACT

A pivot bracket for a convertible boat lounge seat and a bracket in combination with a convertible boat lounge seat having connections for attaching to a pivot bracket beneath and spaced inward of the horizontal seat side edges of the horizontal seat, the bracket having a vertical slot, the bow of a back pivotally and slidably connected to the bracket within the slot for movement of the back into a forward facing position, a rearward facing position, and an upward facing lounge position, the bow pivoting in movement in a slot in the horizontal seat spaced inward from the side edge of the horizontal seat, and bow retaining members spaced forward and aft on the bracket to retain the bow in its forward and rearward facing positions.

10 Claims, 3 Drawing Sheets

PIVOT BRACKET AND CONVERTIBLE SEAT

TECHNICAL FIELD

This invention relates to a unique pivot bracket for a convertible boat lounge seat and for a combination of that seat with the bracket.

BACKGROUND OF THE INVENTION

In small runabout boats and even larger cruisers, it is desirable to have a boat seat with a movable back. The movable back can be placed in a forward facing seating position over the horizontal seat or swung forward to place the back in a rearward facing seating position. It is often desirable to have the back move to one end of the horizontal seat and lay horizontal and aligned with the upper surface of the horizontal seat to convert the seat into a lounge suitable for laying on the lounge for sunbathing or simply resting.

Various techniques have been developed for making a seat convertible into a reclining or lounge seat position. U.S. Pat. No. 5,718,479 shows a convertible seat arrangement where the back of the seat can be placed into the horizontal or lounge position. U.S. Pat. No. 3,743,350 shows a pivot support mechanism for a folding bench, again in which the back of the seat can be placed into the horizontal or lounge position.

However, for convertible lounge seats in boats it is desirable first, that the back of the seat be easily adjusted and not too heavy or difficult to move for the average boater and, in particular, women. This requires that the mechanism for supporting the seat and allowing it to move not be so restrictive as to require excessive force to move the seat into its various positions. Second, it is desirable that the mechanism for supporting and allowing the back of the seat to move not be exposed with sharp edges, large nuts and bolts, or other sharp objects that may come into contact with the user of the seat. This is particularly important in convertible boat lounge seats since passengers on a boat are sometime in unstable positions when the boat is rolling or in waves causing them to brush against or fall against the ends of the seats. Thirdly, it is a desirable feature that the mechanism for supporting and allowing the back of the seat to move not be too costly so as to make it an undesirable feature to have to build into a boat.

SUMMARY OF THE INVENTION

According to the invention, a unique pivot bracket is provided of the type suitable for supporting the back of a seat such that it can be movable into a forward facing position, a rearward facing position, and an upward facing lounge position with the bracket being relatively inexpensive and providing good ease of movement of the back of the seat and good support structure without being costly to assemble or attach to the seat structure.

It is another feature of this invention to use this unique pivotal bracket in combination with the horizontal seat and the movable back such that the movable back is moved into its three operating positions but without the bracket being exposed at the outer surfaces of the seat where it would come in contact with passengers or operators of a boat.

The bracket preferably includes a back plate having fastening members for attaching it to the support structure for the seat, an elongated vertical slot in the back plate, members spaced fore and aft on the back plate to support and limit the motion of a metallic bow on which the back of the seat is mounted. The slot enables the bow to pivotally attach to the bracket so that the bow with the back of the seat attached can swing forward and rearward relative to the horizontal seat to be in respective, rearward and forward facing positions. The slot also allows the bow to be raised up to the top of the slot allowing the bow to then be pivoted into a horizontal position so that the back of the seat can be moved downwardly facing up and in the same horizontal plane as the horizontal upper surface of the seat.

The second feature of the invention is to provide this bracket in combination with a convertible boat seat, the boat seat having a horizontal seat with a forward end and a rearward end and having an upper surface with left and right side edges, with the horizontal seat mounted on a frame or supports attached to the boat. A back having a forward surface and a rear surface is pivotally attached to a pivot bracket which allows the bow of the back to be pivoted forward for a rear facing seating position, pivoted rearward for a forward facing seating position and movable upwardly and rearwardly and then swung down to an upward facing position with the surface of the back of the seat horizontal with and aligned with the upper surface of the horizontal seat. The pivot bracket includes an elongated vertical slot which allows the ends of the bow to not only pivot in the bracket but to be slid vertically upward when the rear seat is swung into the lounge seat position. Two brackets are mounted transversely inward under the horizontal seat cushions so that the bow ends ride in bow receiving slots in the horizontal seat. In this manner the bracket is not exposed to the exterior of the seat so that none of its metallic, sharp or protruding surfaces can be engaged by an operator or passenger in the boat.

DETAILED DESCRIPTION OF THE EMBODIMENTS

Figure 1:
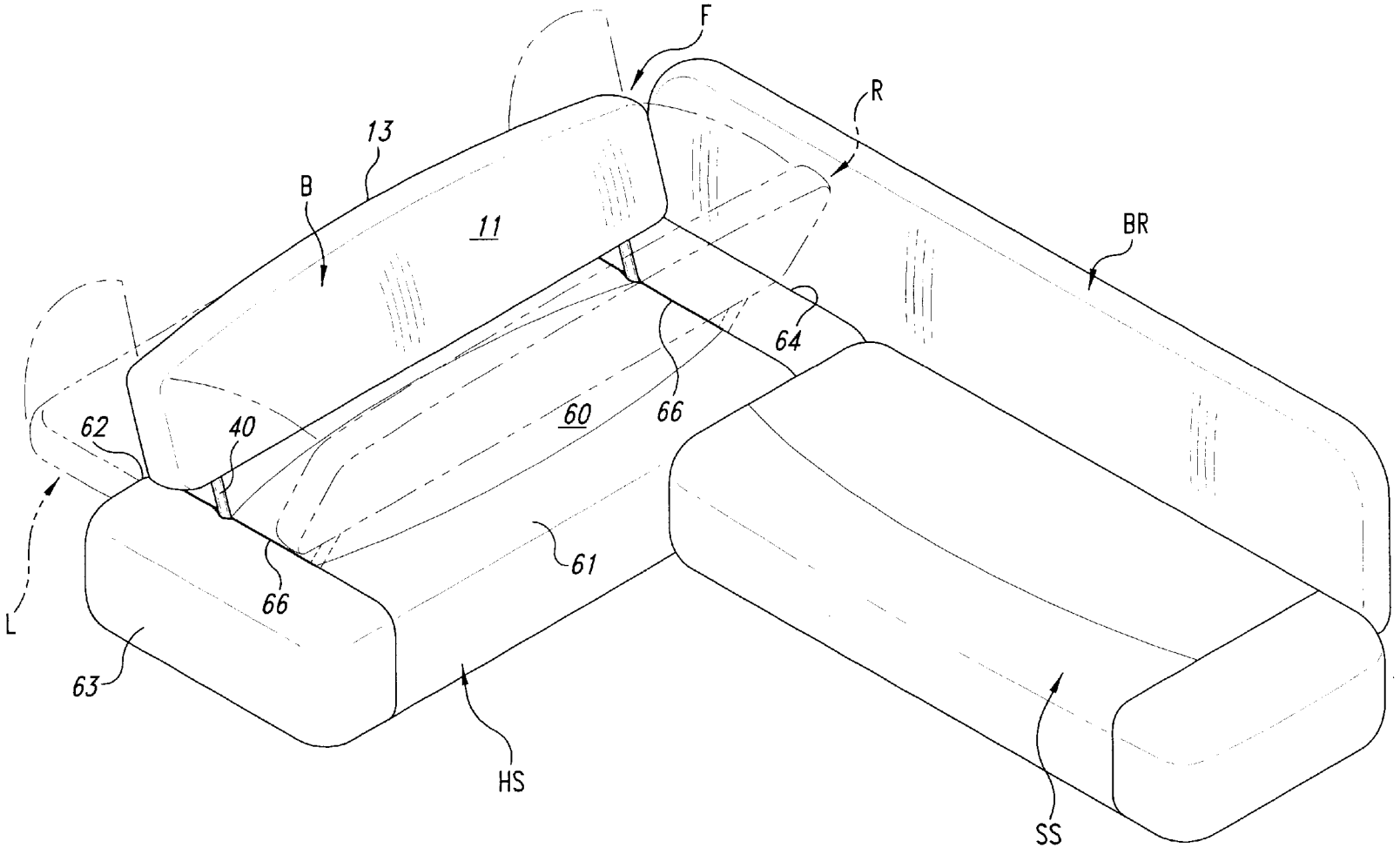
FIG. 1 is an isometric of a convertible boat lounge seat embodying the principles of the invention.

As best shown in FIG. 1, the typical boat seat includes a horizontal seat HS and a movable back B having a forward surface 11 and a reward surface 13. If additional seating for lounging is desired, there is usually a fixed second horizontal seat SS with a fixed back rest BR.

The back can be moved into a rearward facing position shown in phantom lines by the letter R, a forward facing position shown in solid lines by the letter F, and a lounge position shown in phantom lines by the letter L.

It is a unique feature of this invention that a unique pivot bracket 10 (FIG. 3) is provided for supporting the back B in its three operating positions. The bracket is best shown in FIG. 3 and includes a back plate 12 having an elongated vertical slot 14 and a pair of spaced bow retaining members 16. Preferably these bow retaining members are formed by being bent out of the back plate for reduction of cost but could also be bolted or welded on members. The back plate is also provided with upper fastener plates 20 (FIG. 2) which also are bent out of the back plate as indicated by the openings 21 in FIG. 3. Lower fastening plates or flanges 18 are also formed out of the back plate or also could be added on fastening connectors.

Figure 2:
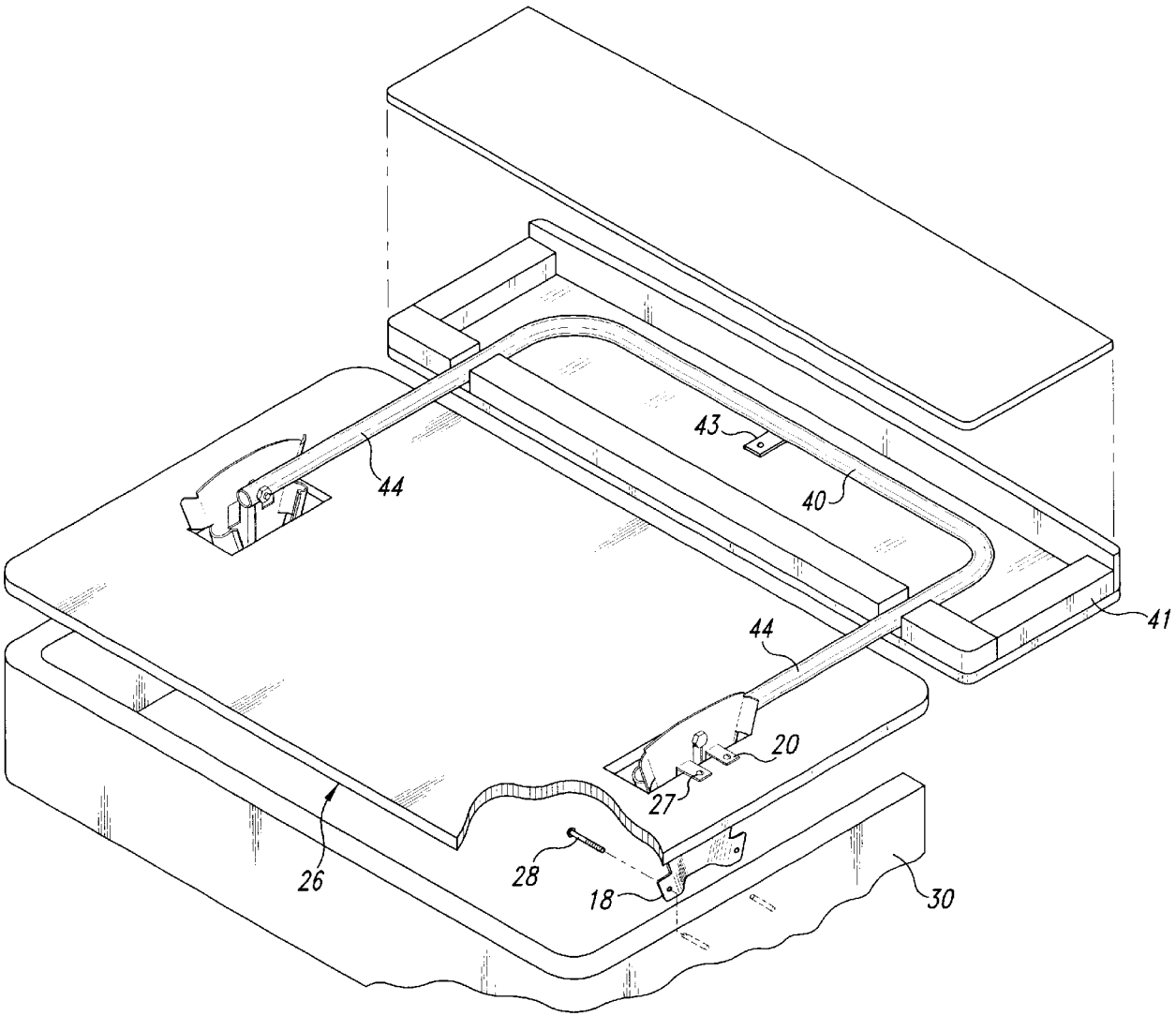
FIG. 2 is an isometric of the frame support and moving mechanism for supporting the back of the seat in the convertible lounge seat shown in FIG. 1.
Figure 3:
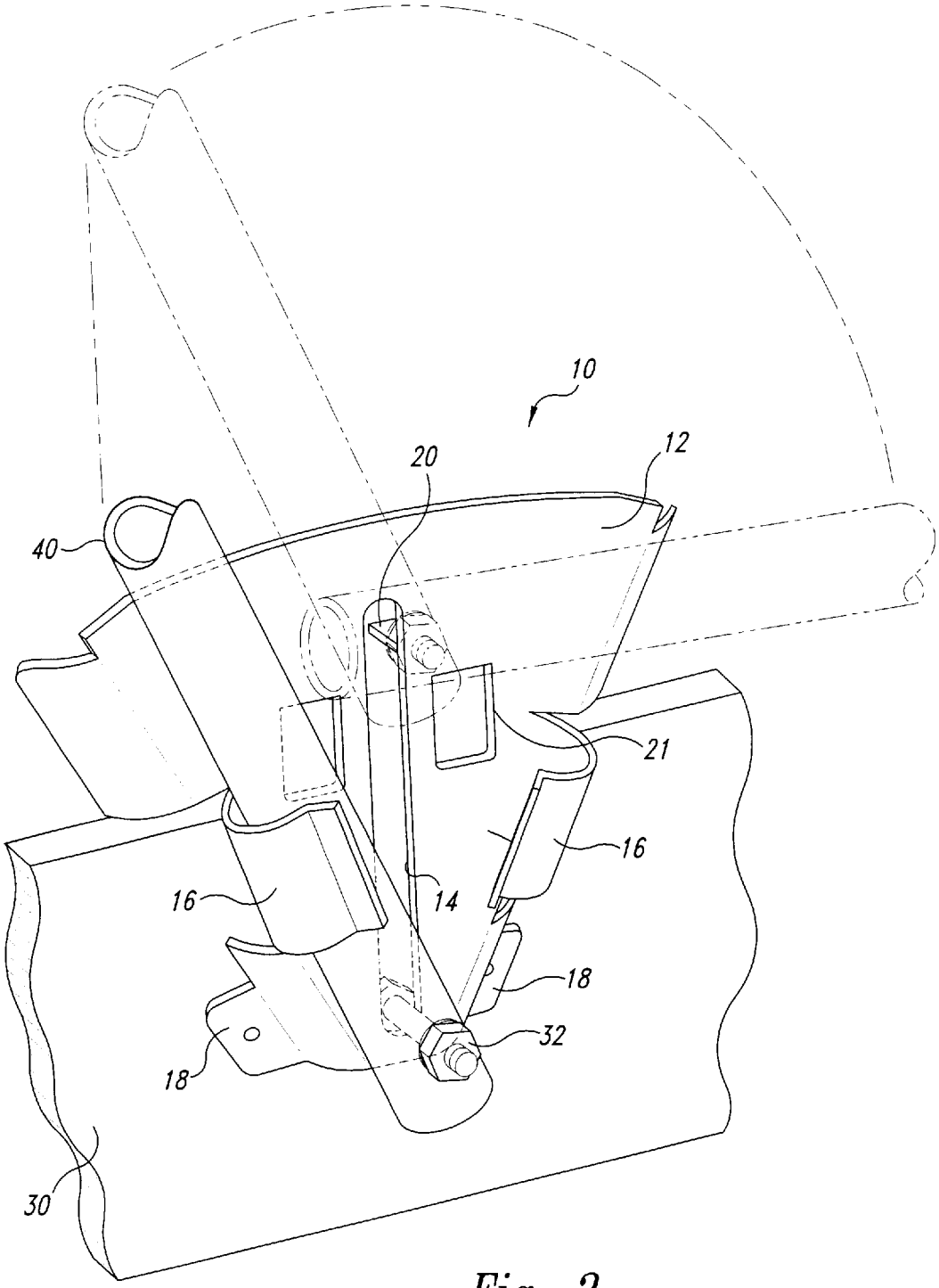
FIG. 3 is an isometric of the unique pivot bracket used to support the bow of the back when the back is moved in its forward facing position, its rearward facing position, or its lounge position.

A back bow 40 is in the form of a U-shape tubular member and is attached to the frame 41 of the back B by a conventional bracket 43 welded or otherwise connected to the bow and screwed into the back frame as shown in FIG. 2. The U-shape bow also has spaced opposed legs 44 that are pivotally connected in the slot 14 by a bolt 32.

The bracket is attached to a horizontal wooden support plate 26 which is secured to either a box frame attached to the cockpit of the boat or attached to elongated seat supports 30 which can be made of fiberglass and molded into the cockpit of the boat. The brackets are attached to the horizontal plate 26 by screws or bolts 27. The lower flanges 18 are attached by screws or bolts 28 to the lower support frame or seat supports 30 as best shown in FIG. 2.

As is well understood, the back frame 41 and the horizontal plate 26 are properly cushioned with conventional boat seat cushion material, as is well known in the art. The horizontal seat HS, however, has an upper surface 60 with a forward end 61, a rear end 62, and opposed side edges 63 and 64. In the upper surface of the horizontal seat there is provided, spaced inwardly from the outer side edges, bow receiving slots 66 that allow the bow 40 to slide for and aft within the horizontal seat cushion. As is readily apparent, all of the fastening members for allowing the back to pivot into any of its three operating positions with the exception of a part of the bow 40 are all concealed within the seats so that no metallic parts are protruding out from the exterior of the seats where they could be engaged by an operator or passenger in the boat.

The operation of the seat is best shown in FIGS. 1 and 3. If we assume that the back bow 40 shown in solid lines in FIG. 3 is in the rearward facing position with the back swung forward so that it is adjacent the forward end 61 of the horizontal seat surface 60 then the seat will be provided for people facing rearward on the seat. If the back bow is swung clockwise in FIG. 3 until the bow is resting within the bow retaining member to the right in FIG. 3 then the back B will be in the solid line position in FIG. 2 adjacent the rearward end 62 of the horizontal seat surface 60 and allowing passengers to face forward. Finally, the bow 40 can be slid vertically upward in the slot 14 and then pivoted clockwise as shown in FIG. 3 with the bow now resting in the horizontal position as shown in FIG. 2. This positions the back B with its forward surface now pointing upward with the forward surface also being generally horizontally aligned with the horizontal cushion surface 60 of the horizontal seat.

The back can be covered with a continuous piece of fabric as there are no sliding brackets or moving back support mechanisms on the back B. Advantageously, the pivot bracket 10 allows conversion from the forward facing, rear facing, and to the lounge positions using only a minimum of parts that need to be assembled. The use of the bow legs pivoted in the elongated slot 14 and being supported on the plate 26 in the lounge position gives the back considerable strength when in the lounge position. The pivot points for the bow legs are well below the seat's surface and the arrangement of the bracket and bow give considerable strength without a lot of extra pieces to assemble.

The invention having thus been described it will be obvious that variations will be possible to those skilled in the art and thus the invention should not be limited to the specific embodiment illustrated in the drawings.

What is claimed is:

1. A pivot bracket for a convertible boat seat for use on a seat having a horizontal seat with an upper surface and a movable back, the movable back being movable between forward facing, rear facing and upward facing positions with the back having a seating surface for facing upward when in said upward facing position and a back bow, the bracket comprising:

a back plate having upper and lower fastener plates, a set of horizontally spaced upright forward and rearward bow retaining members, and an elongated vertical slot having an upper end;

said back plate slot adapted to pivotally receive said seat back bow within said vertical slot to allow the back bow to pivot forward into engagement with said forward bow retaining member, rearward into engagement with said rearward bow retaining member, and to move vertically upward in said slot to be raised and pivoted at the upper end of said slot clear of the bow retaining members for laying the seat back in a horizontal position with said seating surface facing upward and in the same horizontal plane as the upper surface of the horizontal seat to make a lounge.

2. A pivot bracket for a convertible boat seat for use on a seat having a horizontal seat and a movable back, the movable back being movable between forward facing rear facing and upward facing positions the bracket comprising:

a back plate having per and lower fastener plates, a set of horizontally spaced upright forward and rearward bow retaining members, and an elongated vertical slot having an upper end:

said back plate slot adapted to pivotally receive a seat back bow within said vertical slot to allow the back bow to pivot forward into engagement with said forward bow retaining member, rearward into engagement with said rearward bow retaining member and to move vertically upward in said slot to be raised and pivoted at the upper end of said slot; and said bow retaining members each including a bent curved flange bent out of said back plate.

3. A pivot bracket for a convertible boat seat for use on a seat having a horizontal seat and a movable back, the movable back being movable between forward facing, rear facing and upward facing positions, the bracket comprising:

a back plate having upper and lower fastener plates, a set of horizontally spaced upright forward and rearward bow retaining members and an elongated vertical slot having an upper end;

said back plate slot adapted to pivotally receive a seat back bow within said vertical slot to allow the back bow to pivot forward into engagement with said forward bow retaining member, rearward into engagement with said rearward bow retaining member and to move vertically upward in said slot to be raised and pivoted at the upper end of said slot, and said upper fastener plates being horizontal flanges bent out of said back plate and extending outwardly from said back plate in the direction opposite said bow retaining members.

4. The bracket of claim 3, wherein said bow retaining members each including a bent curved flange bent out of said back plate.

5. A convertible lounge seat for a boat comprising:

a horizontal seat having an upper surface with a forward end and a rearward end, left and right side edges, said horizontal seat mounted on a support having opposite vertical sides;

a movable back;

said back having a forward surface and a rearward surface;

said back being movable so that the forward surface of the back is adjacent the forward end of the horizontal seat into a rearward facing position, movable so that the rearward surface of the back is adjacent the rear end of the horizontal seat into a forward facing position, and movable so that the forward surface of the back is facing upward and aligned horizontally with the upper surface of the horizontal seat into a lounge position;

the improvement comprising:

a set of transversely spaced pivot brackets mounted to said support under said horizontal seat;

said horizontal seat having a set of transversely spaced bow receiving slots spaced inwardly from said left and right side edges;

said back attached to an elongated U-shaped bow having opposite spaced legs, said legs passing through said bow receiving slots and pivotally connecting to said pivot brackets;

each said pivot bracket having an elongated vertical slot slidably and pivotally receiving said legs of said bow so that the seat back can pivot forward, rearward and the bow legs slide up in said elongated vertical slot so the back can be lifted upward and then swung rearward into said lounge position.

6. The lounge seat of claim 5, wherein said pivot bracket includes a back plate having upper and lower fastener plates and a set of horizontally spaced upright forward and rearward bow retaining members.

7. The lounge seat of claim 5, wherein said pivot bracket includes spaced bow retaining members each including a bent curved flange.

8. The lounge seat of claim 7, wherein said pivot bracket includes a back plate having upper and lower fastener plates and wherein said pivot bracket upper fastener plates are horizontal flanges bent out of said back plate and extending outwardly from said back plate in the direction opposite said bow retaining members.

9. A pivot bracket for a convertible boat seat for use on a seat having a horizontal seat with an upper horizontal surface and a movable back, the movable back being movable between an upright position and a lowered horizontal upward facing position with the back having a seating surface for facing upward when in said upward facing position and a back bow, the bracket comprising:

a back plate having fastening members for attaching the back plate to the seat, at least one bow bow retaining member, and an elongated vertical slot having an upper end;

said back plate vertical slot adapted to pivotally receive said back bow within said vertical slot to allow the back bow to pivot into engagement with said bow retaining member, and to move vertically upward in said slot to be raised and pivoted at the upper end of said slot clear of the bow retaining member for laying the back in a horizontal position with said seating surface facing upwardly and in the same horizontal plane as the upper horizontal surface of the horizontal seat to make a lounge.

10. The bracket of claim 9, further including a second bow retaining member spaced from said first bow retaining member to provide forward and rearward bow retaining members, said back plate vertical slot adapted to allow the back bow to pivot forward into engagement with said forward bow retaining member, rearward into engagement with said rearward bow retaining member as well as to move vertically in the slot clear of the bow retaining members when moving the back into the horizontal lounge position.

* * * * *